US005933808A

United States Patent [19]

Kang et al.

[11] Patent Number: 5,933,808

[45] Date of Patent: Aug. 3, 1999

[54] METHOD AND APPARATUS FOR GENERATING MODIFIED SPEECH FROM PITCH-SYNCHRONOUS SEGMENTED SPEECH WAVEFORMS

[75] Inventors: George S. Kang, Silver Spring; Lawrence J. Fransen, Annapolis, both of Md.

[73] Assignee: The United States of America as represented by the Secretary of the Navy, Washington, D.C.

[21] Appl. No.: 08/553,161

[22] Filed: Nov. 7, 1995

[51] Int. Cl.[6] ..... G10L 5/04; G10L 9/08

[52] U.S. Cl. ..... 704/278; 704/207; 704/218; 704/241

[58] Field of Search ..... 395/2.16, 2.27, 395/2.5, 2.87; 704/207, 218, 248, 278

[56] References Cited

U.S. PATENT DOCUMENTS

| | | | |
|---|---|---|---|
| 3,535,454 | 10/1970 | Miller | 704/268 |
| 3,649,765 | 3/1972 | Rabiner et al. | 704/209 |
| 3,928,722 | 12/1975 | Nakata et al. | 704/267 |
| 4,246,617 | 1/1981 | Portnoff | 360/32 |
| 4,435,832 | 3/1984 | Asada et al. | 704/262 |
| 4,520,502 | 5/1985 | Fujita | 704/268 |
| 4,561,337 | 12/1985 | Wachi | 84/604 |
| 4,672,667 | 6/1987 | Scott et al. | 704/231 |
| 4,852,169 | 7/1989 | Veeneman et al. | 704/207 |
| 5,003,604 | 3/1991 | Ozaki et al. | 704/207 |
| 5,054,085 | 10/1991 | Meisel et al. | 704/207 |
| 5,113,449 | 5/1992 | Blanton et al. | 704/261 |
| 5,127,053 | 6/1992 | Koch | 704/207 |
| 5,422,977 | 6/1995 | Patterson et al. | 704/276 |
| 5,479,564 | 12/1995 | Vogten et al. | 704/267 |

OTHER PUBLICATIONS

Carl W. Helstrom, Statistical Theory Of Signal Detection, second edition, Pergamon, p. 19, 1968.

L.R. Rabiner and R.W. Schafer, "Digital Processing of Speech Signals", Prentice–Hall Inc., Englewood Cliffs, NJ, 1978, Chapter 4.

G.S. Kang, L.J. Fransen and E.L. Kline, "Multirate Processor (MRP) for Digital Voice Communications", Naval Research Laboratory, Washington, D.C., Mar. 21, 1979, p. 60.

G.S. Kang and L.J. Fransen, "Second Report of the Multirate Processor (MRP) for Digital Voice Communications", Naval Research Laboratory, Washington, D.C., Sep. 30, 1982.

G.S. Kang and L.J. Fransen, "Low–Bit Rate Speech Encoders Based on Line–Spectrum Frequencies (LSFs)", Naval Research Laboratory, Washington, D.C., Jan. 24, 1985.

G.S. Kang and L.J. Fransen, "High–Quality 800–b/s Voice Processing Algorithm", Naval Research Laboratory, Washington, D.C., Feb. 25, 1991.

Colin J. Powell, "C41 for the Warrior", Jun. 12, 1992.

"Digital Voice Processor Consortium Report on Performance of the LPC–10e Voice Processor".

(List continued on next page.)

*Primary Examiner*—David R. Hudspeth
*Assistant Examiner*—Tālivaldis Ivars Šmits
*Attorney, Agent, or Firm*—Thomas E. McDonnell; George Jameson

[57] ABSTRACT

A system that synchronously segments a speech waveform using pitch period and a center of the pitch waveform. The pitch waveform center is determined by finding a local minimum of a centroid histogram waveform of the low-pass filtered speech waveform for one pitch period. The speech waveform can then be represented by one or more of such pitch waveforms or segments during speech compression, reconstruction or synthesis. The pitch waveform can be modified by frequency enhancement/filtering, waveform stretching/shrinking in speech synthesis or speech disguise. The utterance rate can also be controlled to speed up or slow down the speech.

5 Claims, 13 Drawing Sheets

OTHER PUBLICATIONS

Proceedings ICASSP 85, IEEE International Conference on Acoustics, Speech, and Signal Processing, vol. 1, "Automatic Speaker Recognition Using Vocoded Speech", Stephanie S. Everett, Naval Research Laboratory, Washington, D.C., pp. 383–386.

Alan V. Oppenheim and Ronald W. Schafer, "Discrete–Time Signal Processing", Prentice–Hall, Englewood Cliffs, NJ, Chapter 10 –Discrete Hilber Transforms, pp. 674–675.

G.S. Kang, T.M. Moran and D.A. Heide, Voice Message Systems for Tactical Applications (Canned Speech Approach), Naval Research Laboratory, Washington, D.C., Sep. 3, 1993.

Ralph K. Potter, George A. Kopp and Harriet Green Kopp, "Visible Speech", Dover Publications, Inc., New York, pp. 1–3 and 4.

Athanasios Papoulis, "Signal Analysis", McGraw–Hill Book Company, p. 66.

Thomas E. Tremain, "The Government Standard Linear Predictive Coding Algorithm: LPC–10", *Speech Technology–Man/Machine Voice Communications*, vol. 1, No. 2, Apr. 1982, pp. 40–43.

Homer Dudley, "The Carrier Nature of Speech", *Speech Synthesis*, Benchmark Papers in Acoustics, 1940, pp. 22–43.

FF9, Identifying familiar talkers over a 2.4 kbpa LPC voice system, Astrid Schmidt–Nielsen (Code 7526, Naval Research Laboratory, Washington, D.C. 20375).

George S. Kang and Lawerence J. Fransen, "Speech Analysis and Synthesis Based on Pitch–Synchronous Segmentation of the Speech Waveform", Naval Research Laboratory, Nov. 9, 1994.

DARPA TIMIT Acoustic Phoenetic Continuous Speech Database, Training Set: 420 Talkers, 4200 Sentences, Prototype, Dec. 1988.

G.S. Kang and Stephanie S. Everett, "Improvement of the Excitation Source in the Narrow–Band Linear Prediction Vocoder", *IEEE Transactions on Acoustics, Speech, and Signal Processing*, vol. ASSP–33, No. 2, Apr. 1985, pp. 377–386.

METHOD AND APPARATUS FOR GENERATING MODIFIED SPEECH FROM PITCH-SYNCHRONOUS SEGMENTED SPEECH WAVEFORMS

BACKGROUND OF THE INVENTION

1. Field of the Invention

The present invention is directed to a system for processing human speech and, more particularly, to a system that pitch-synchronously segments the human speech waveform into individual pitch waveforms which may be transformed, replicated, and concatenated to generate continuous speech with desired speech characteristics.

2. Description of the Related Art

The ability to alter speech characteristics is important in both military and civilian applications with the increased use of synthesized speech in communication terminals, message devices, virtual-reality environments, and training aids. Currently, however, there is no known method capable of modifying utterance rate, pitch period, or resonant frequencies of speech by operating directly on the original speech waveform.

Typical speech analysis and synthesis are based on a model that includes a vocal tract component consisting of an electrical filter and a glottis component consisting of an excitation signal which is usually an electrical signal generator feeding the filter. A goal of these models is to convert the complex speech waveform into a set of perceptually significant parameters. By controlling these parameters, speech can be generated with these models. To derive human speech model parameters accurately, both the model input (turbulent air from the lungs) and the model output (speech waveform) are required. In conventional speech models, however, model parameters are derived using only the model output because the model input is not accessible. As a result, the estimated model parameters are not often accurate.

What is needed is a different way of representing speech that does not represent speech as an electrical analog sound production mechanism.

SUMMARY OF THE INVENTION

It is an object of the present invention to represent the speech waveform directly by individual waveforms beginning and ending with the pitch epoch. These waveforms will be referred to as pitch waveforms.

It is another object of the present invention to segment the speech waveform into pitch waveforms.

It is also an object of the present invention to perform pitch synchronous segmentation to obtain pitch waveforms by estimating the center of a pitch period by means of centroid analysis.

It is an additional object of the present invention to use the ability to segment the speech waveform to perform speech analysis/synthesis, speech disguise or change, articulation change, boosting or enhancement, timber change and pitch change.

It is an object of the present invention to utilize segmented pitch waveforms to perform speech encoding, speech recognition, speaker verification and text to speech.

It is a further object of the present invention to provide a speech model that is not affected by pitch interference, that is, segmented pitch waveform spectrum is free of pitch harmonics.

The above objects can be attained by a system that uses an estimate of the pitch period and an estimation of the center of the pitch waveform to segment the speech waveform into pitch waveforms. The center of the pitch waveform is determined by finding the centroid of the speech waveform for one pitch period. The centroid is found by finding a local minimum in the centroid histogram waveform, such that the local minimum corresponds to the midpoint of the pitch waveform. The midpoint or center of the pitch waveform along with the pitch period is used to segment or divide the speech waveform. The speech waveform can then be represented by a set of such pitch waveforms. The pitch waveform can be modified by frequency enhancement/filtering, waveform stretching/shrinking in speech synthesis. The utterance rate of the speech can also be changed by increasing or decreasing the number of pitch waveforms in the output.

BRIEF DESCRIPTION OF THE DRAWINGS

These and other objects, features and advantages of the invention, as well as the invention itself, will become better understood by reference to the following detailed description when considered in connection with the accompanying drawings wherein like reference numerals designate identical or corresponding parts throughout the several views and wherein:

FIG. 10(*b*) depicts control timing diagrams;

DESCRIPTION OF THE PREFERRED EMBODIMENTS

This invention is directed toward a speech analysis/synthesis model that characterizes the original speech waveform. In this invention, the speech waveform is modeled as a collection of disjoint waveforms, each representing a pitch waveform. Note that a pitch period is the time duration or the number of speech samples present in the pitch waveform. A segmented waveform of one pitch period can represent neighboring pitch waveforms because of the redundancy inherent in speech. Speech is reconstructed by replicating within a frame and concatenating from frame to frame the segmented pitch waveforms.

Figure 1:
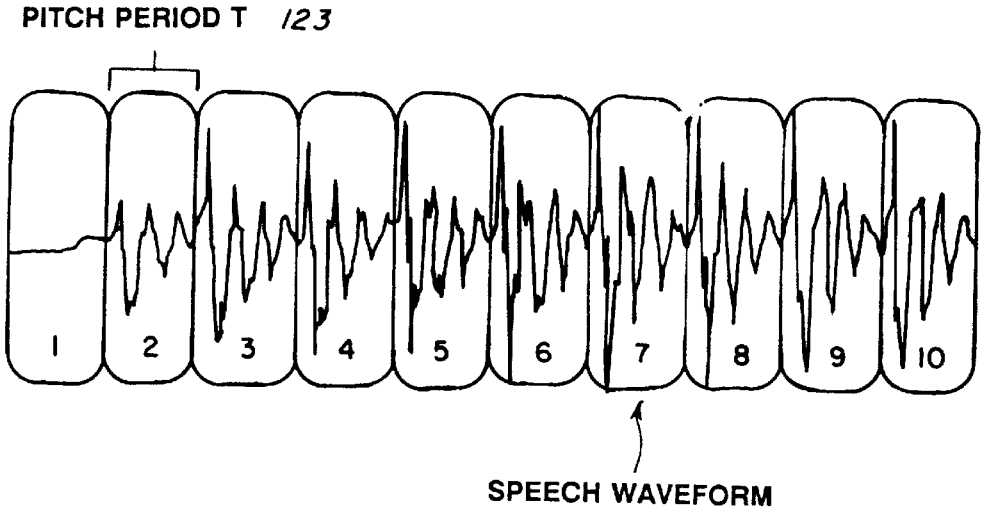
FIG. 1 depicts a speech waveform with delineated pitch waveforms and an associated pitch period.

The present invention is a technique for segmenting pitch waveforms from a speech waveform of a person based on pitch. The inventors have recognized that the speech waveform, as illustrated in FIG. 1, is a collection of disjoint waveforms 1–10 where waveforms 2–10 are the result of the glottis opening and closing at the pitch rate. A purpose of the invention is to segment individual pitch waveforms. As noted previously, a segmented waveform of one pitch period T 123 can represent neighboring pitch waveforms because of the slowly varying nature of the speech waveform. One pitch waveform representing more than one pitch waveform is an important aspect of speech compression and synthesis. In the example of FIG. 1, eight pitch waveforms 3–10 are substantially similar. Because one pitch waveform represents speech that may have many pitch waveforms, speech compression is possible. Modification of the speech waveform can be accomplished by modifying only a portion of the speech waveform or the representative pitch waveform, an advantage in speech modification and synthesis.

The segmentation of a speech waveform into pitch waveforms requires two computational steps: 1) the determination of the pitch period; and 2) the determination of a starting point for the pitch waveform. Determining the pitch period can be performed using conventional techniques typically found in devices called vocoders. To determine the starting point of the pitch waveform, the center of the pitch waveform is determined first, in accordance with the present invention, by centroid histogram waveform analysis.

The location of the centroid (or center of gravity), as used in mechanics, is expressed by centroid function $$\eta = \frac{\int_{x1}^{x2} x f(x)\,dx}{\int_{x1}^{x2} f(x)\,dx} \text{ for } x1 \le x \le x2 \tag{1}$$

where f(x) is a non-negative mass distribution, and [x1, x2] is the domain of variable x. In this invention, x is a time variable, f(x) is the speech waveform, and the domain [x1, x2] where $x_2-x_1$, is one pitch period. Since f(x) cannot be negative, a sufficient amount of bias is added to the speech waveform so that f(x)>0.

Figure 2:
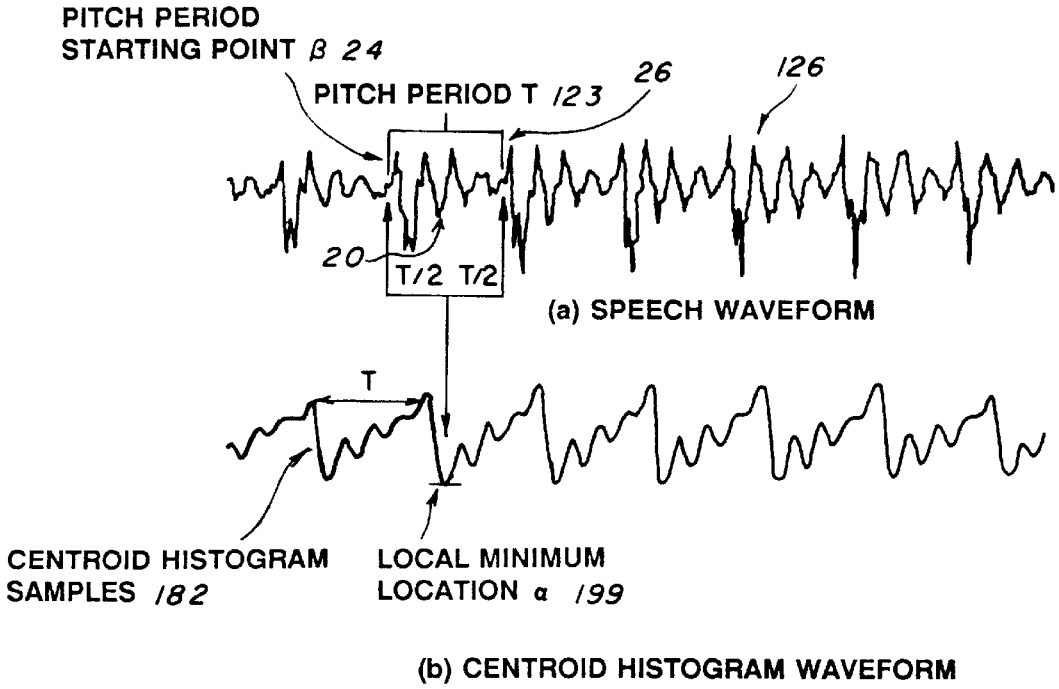
FIGS. 2(*a*) and 2(*b*) respectively depict a low-pass filtered speech waveform and a centroid histogram waveform for the speech waveform.

FIGS. 2(*a*) and 2(*b*) respectively show a low pass filtered speech samples S'(.) 126 and centroid histogram samples C(.) 182 of the centroid function. The center of a pitch period is defined to be at a local minimum of the centroid histogram samples C(.) 182 of the speech waveform for that pitch period. A local minimum location α 199 of the samples C(.) 182 occurs at a midpoint 20 of a pitch period T 123. Knowing the location α 199 and the pitch period T 123 allows a pitch period starting point β 24 and a pitch period ending point 26 of the pitch period T 123 to be determined. The pitch period starting point β 24 and ending point 26 define the boundaries of the pitch period T 123. By using the centroid to determine the segmentation, the present invention results in a balancing of the "weight" or left and right moments of the pitch waveform samples around the centroid.

Figure 3:
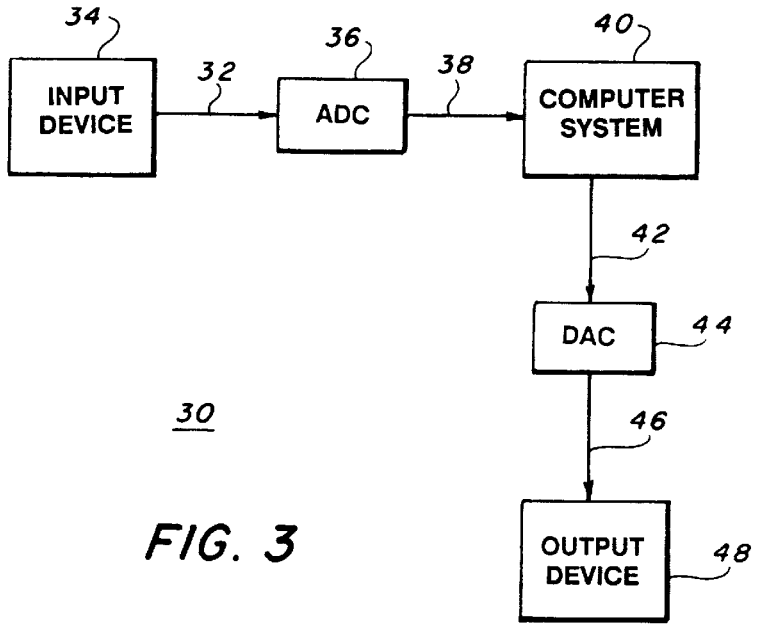
FIG. 3 depicts the typical hardware of the present invention in a preferred embodiment.
Figure 4:
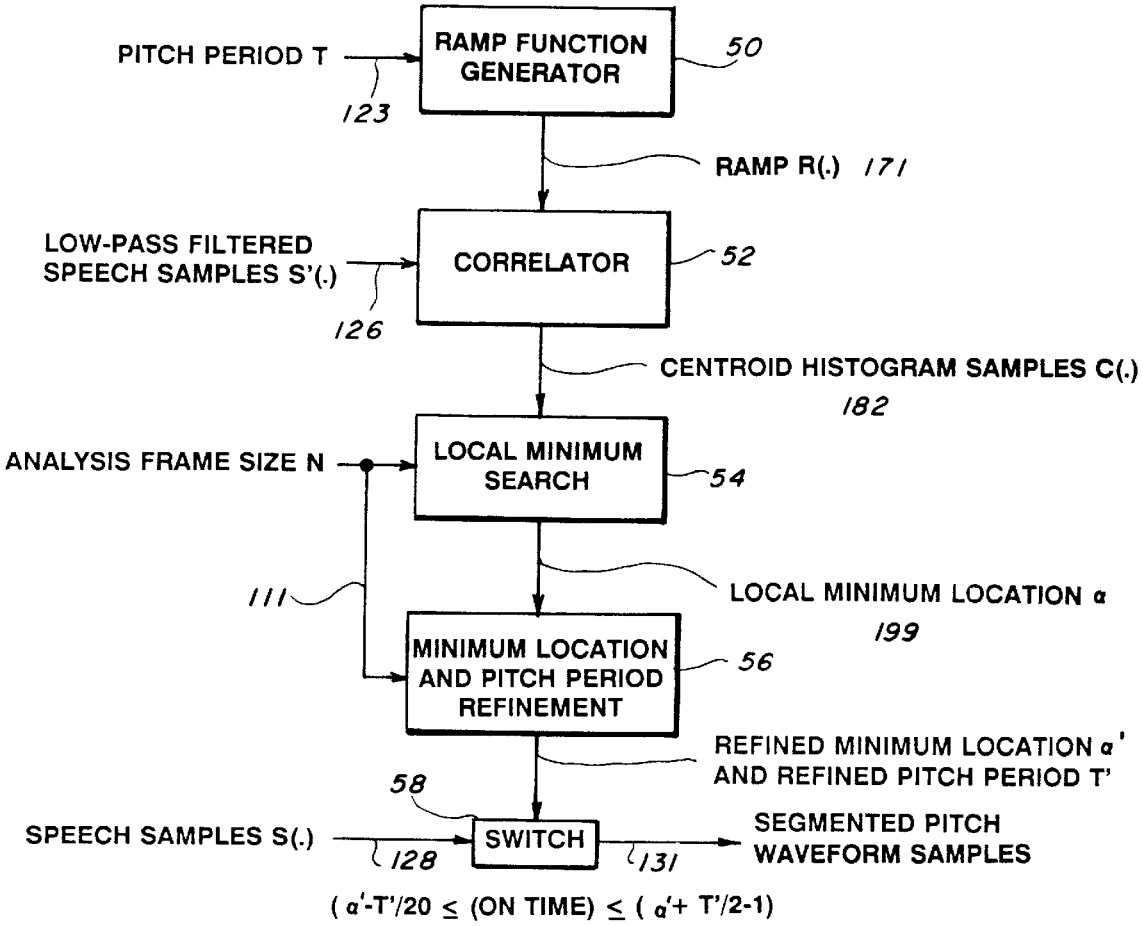
FIG. 4 shows the pitch synchronous segmentation operation of the present invention performed by the computer system 40 of FIG. 3.

The segmentation of the waveform samples, in accordance with the present invention, is preferably performed using a system 30 as illustrated in FIG. 3. An input analog speech signal 32, such as a human voice that is to be compressed or modified, from an input device 34, such as a microphone, is sampled by a conventional analog-to-digital converter (ADC) 36 at a conventional sampling rate suitable for speech processing. Digitized speech samples 38 are provided to a conventional computer system 40, such as a Sun workstation or a desktop personal computer. The computer system 40 performs the segmentation (as indicated in FIG. 4—to be discussed) and any analysis or processing required for speaker verification, speaker recognition, text to speech, compression, modification, synthesis, etc. The segmented waveform in modified or unmodified form can be stored in a memory (disk or RAM—not shown) of the system 40. If the waveform is being modified, such as when disguised speech is to be produced, modified speech waveform 42 samples are converted by a conventional digital-to-analog converter (DAC) 44 into an analog speech signal 46 and provided to an output device 48, such as a speaker. The process of the present invention can also be stored in a portable medium, such as a disk, and carried from system to system.

The segmentation operation segments by determining the centroid, which is performed by the computer system 40, as illustrated in detail in FIG. 4. This segmentation operation starts by generating a ramp R(.) 171 of one pitch period duration in a ramp function generator 50. More specifically, the generator 50 is responsive to a pitch period T 123 for generating ramp R(.) 171, expressed by $$R(i) = \begin{cases} i & \text{for } -T/2 \le i \le T/2-1 \\ 0 & \text{elsewhere} \end{cases} \tag{2}$$

The ramp R(.) 171 is then correlated in a correlator 52 with low pass filtered speech samples S'(.) 126 to produce a centroid function or the centroid histogram samples C(.) 182. The use of low pass filtered speech samples S'(.) 126 is preferred because it is free of high frequency information often present in the speech waveform. By definition, a centroid function is the sum of the products of the ramp R(.) 171 samples and the low-pass filtered speech samples S'(.) 126 with a successive mutual delay (which is a cross correlation function). Thus, the centroid histogram samples C(.) 182 are expressed by $$\begin{aligned} C(i) &= \sum_{j=-T/2}^{T/2-1} R(j)S'(i+j) \quad L-T/2 \le i \le L+T/2-1 \\ &= \sum_{j=-T/2}^{T/2-1} jS'(i+j) \quad L-T/2 \le i \le L+T/2-1 \end{aligned} \tag{3}$$

where L is the midpoint of the centroid analysis frame. As noted from the above expression (3), the samples C(.) 182 are computed for one pitch period around the center of the analysis frame. The typical centroid histogram samples C(.) 182 waveform is illustrated in FIG. 2(*b*), which was previously discussed.

Next, a local minimum search 54 is performed on the samples C(.) 182 (see FIG. 4) to determine a local minimum location α. As previously noted, the midpoint of the pitch waveform coincides with the local minimum of the samples C(.) 182. This minimum location, denoted by α 199, is obtained from $$\alpha = \min_i \{C(i)\} \quad L - T/2 \le i \le L + T/2 - 1 \tag{4}$$

As illustrated in FIGS. 2(*a*) and 2(*b*), the minimum location α 199 corresponds to the midpoint 20 of the pitch period T 123. Thus, the pitch epoch begins at α−T/2, the pitch period starting point β 24, and ends at α+T/2−1 or pitch period ending point 26.

The minimum location α 199 needs refinement because the pitch period T 123 provided by a pitch tracker 121 (FIG. 9) is often not too accurate. Thus, both the local minimum location a 199 and pitch period T 123 are refined by repeating the above local minimum search 54 for each T±ΔT where ΔT is as much as T/16 (6.25% of T). This refinement 56 improves the segmentation performance. The refined local minimum location and refined pitch period are denoted by α' and T', respectively.

Finally, segmented pitch waveform samples 131 are excised from the speech samples S(.) 128 by a switch 58 from time α'−T'/2 to time α'+T'/2−1.

Once the segmented pitch waveform samples 131 are excised they can be modified, replicated, etc., as will be discussed in more detail later, to produce a reconstructed speech waveform. This is accomplished by replicating and concatenating pitch waveforms. Because the synthesis frame size M is generally greater than the pitch period T', the segmented speech waveform is usually replicated more than once. The segmented waveform is always replicated in its entirety. Near the boundary of the synthesis frame, it is necessary to decide whether the segmented waveform of the current frame should be replicated again or the segmented waveform of the next frame should be copied. The choice is determined by the remaining space in relation to the length of the segmented waveform T'. If the remaining space is greater than T'/2, the segmented waveform of the current frame is replicated again. On the other hand, if the remaining space is less than or equal to T'/2, the segmented waveform of the next frame is copied. Any significant discontinuity at either of the segmented pitch waveform boundarys 24 and 26 (FIG. 2(*a*)) will produce clicks or warbles in the reconstructed speech. To avoid discontinuities, the system performs a three-point interpolation at the pitch epoch (see FORTRAN program on pages A1 through A10 of the Appendix for details of this operation).

As noted previously the segmented pitch waveform samples 131 can be used for speaker verification, speaker recognition, text to speech, compression, synthesis or modification of the speech waveform. The modification operation can independently modify the utterance rate, the pitch, and the resonance frequencies of the original speech waveform.

Figure 5:
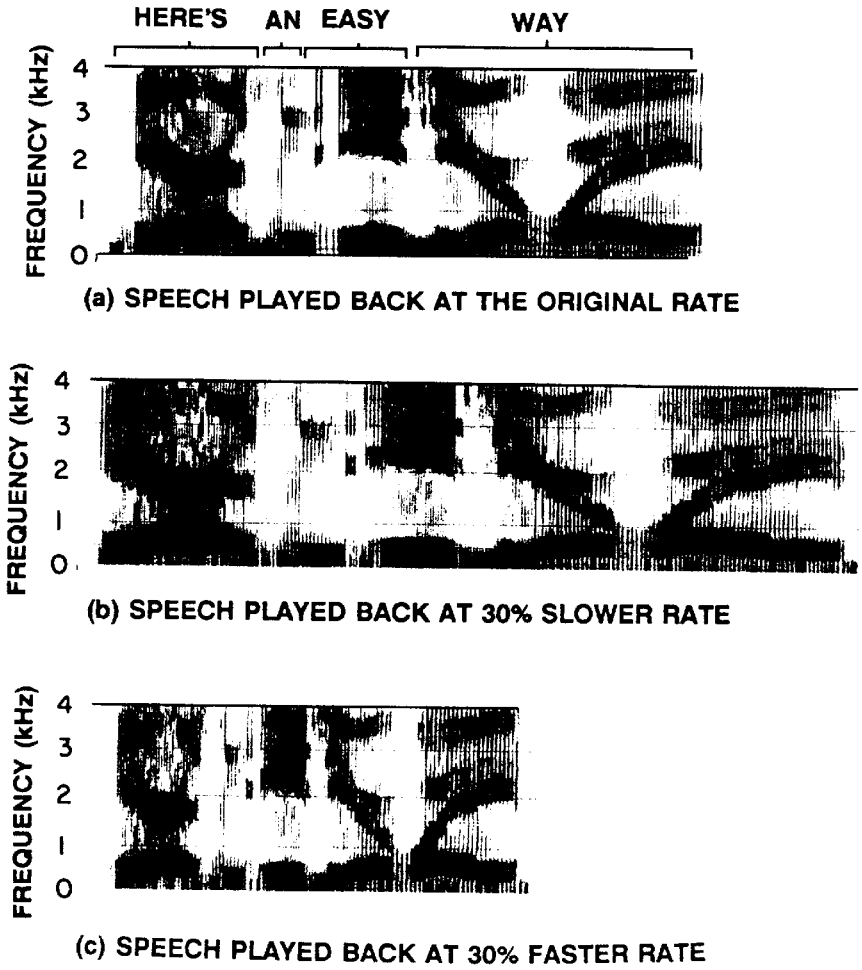
FIGS. 5(*a*), 5(*b*) and 5(*c*) illustrate utterance rate changes.
Figure 6:
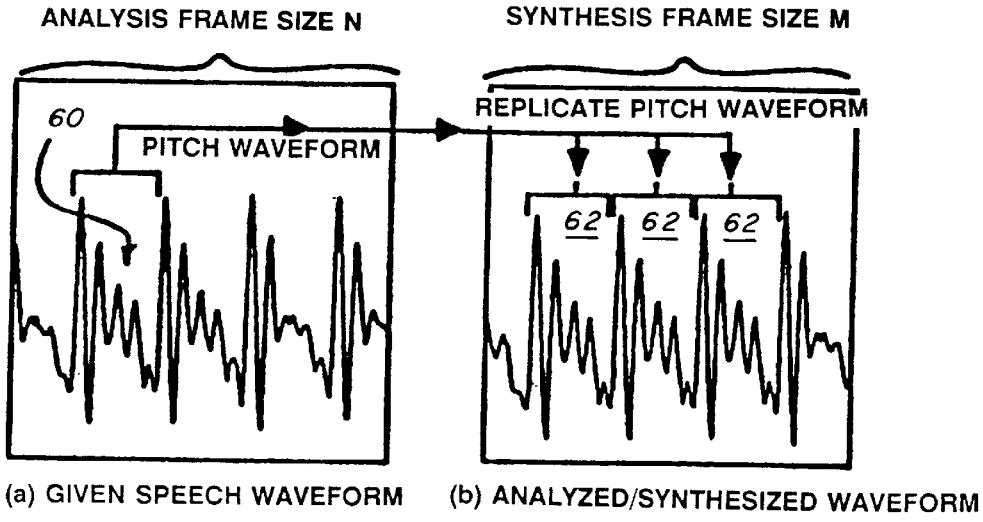
FIG. 6 illustrates pitch waveform replication to generate continuous speech.

Referring now to FIGS. 5(*a*)–5(*c*), the speech utterance rate is altered by simply changing the number of pitch waveforms replicated at the output. Therefore, the utterance rate is controlled by synthesis frame size, M, relative to the analysis frame size, N, which are internal parameters that can be altered by the operator. The relationship of N and M are shown in FIG. 6. Three cases for the relationship between N and M are: (1) M=N: In this case, the utterance rate is unaltered because the same number of pitch waveforms are present in both the input and output frames (see FIG. 5(*a*)). (2) M>N: The output speech is slowed down by replicating the pitch waveform 60 more than once, producing replicated waveforms 62 used to fill the synthesis frame M (see FIG. 5(*b*) for an example). (3) M<N: The output speech is sped up because the output frame M has fewer pitch waveforms than the input frame N (see FIG. 5(*c*)). In these examples of utterance rate change the pitch period and resonance frequencies of the original speech are not affected by modifying the speech rate.

Pitch can be changed by expanding or compressing the pitch waveform. Alteration of the pitch period in this invention does not affect the speech utterance rate, but resonant frequencies do change in proportion to the pitch. It is common knowledge that high-pitch female voices have higher resonant frequencies than low-pitch male voices for the same vowel. The natural coupling of pitch frequency and resonant frequencies is beneficial.

Figure 7:
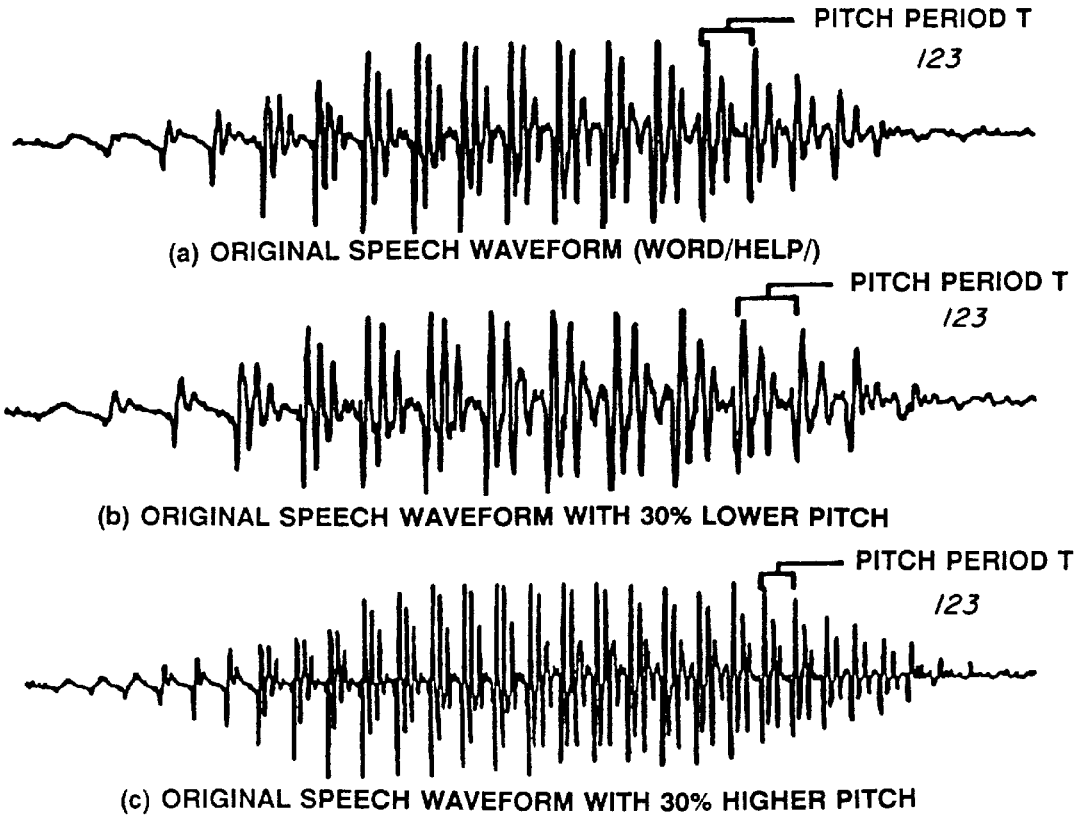
FIGS. 7(*a*), 7(*b*) and 7(*c*) depict pitch alteration.

FIGS. 7(*a*)–7(*c*) illustrate the effect of changing the pitch. FIG. 7(*a*) shows the original speech. FIG. 7(*b*) is altered speech played back with a 30% lower pitch. FIG. 7(*c*) is altered speech played back with a 30% higher pitch.

Figure 8:
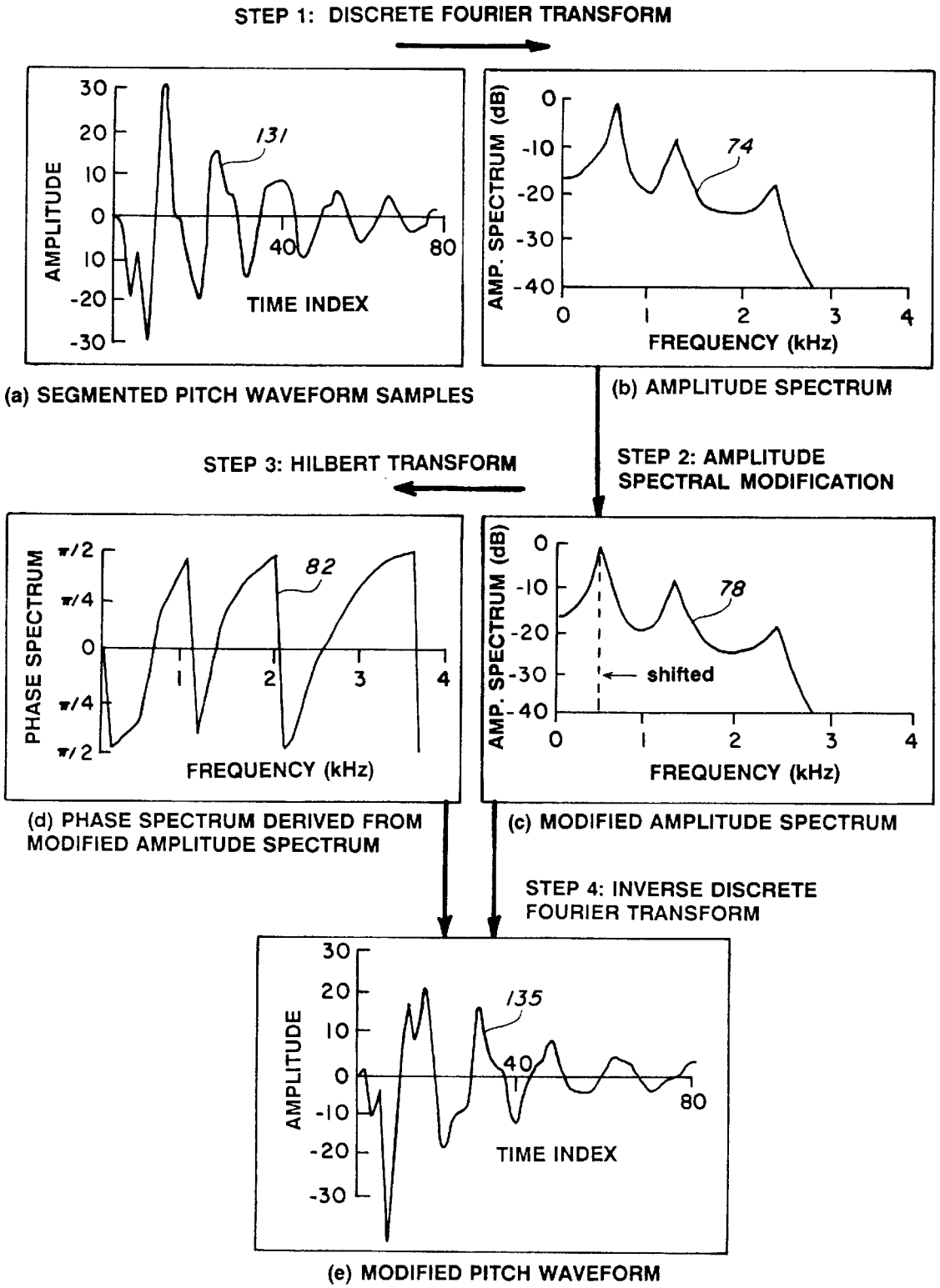
FIG. 8 depicts spectrum modifications.

The resonant frequencies of speech can be modified by altering the pitch waveform spectrum. An example of such an alteration is illustrated in FIG. 8. In step 1, a conventional discrete Fourier transform (DFT) is applied to the segmented pitch waveform samples 131 to produce an amplitude spectrum 74. In step 2, the spectrum 74 is modified in some conventional manner to produce a modified amplitude spectrum 78. For example, the first resonant frequency in the spectrum 74 can be shifted to the left as shown by the spectrum 78. In step 3, a conventional Hilbert transformation is performed on spectrum 78 to produce a modified phase spectrum 82. In step 4, an inverse discrete Fourier transform (IDFT) is performed on amplitude spectrum 78 and phase spectrum 82 to produce a modified pitch waveform 135 with altered spectral characteristics. This waveform 135 can then be used to generate speech.

Figure 9:
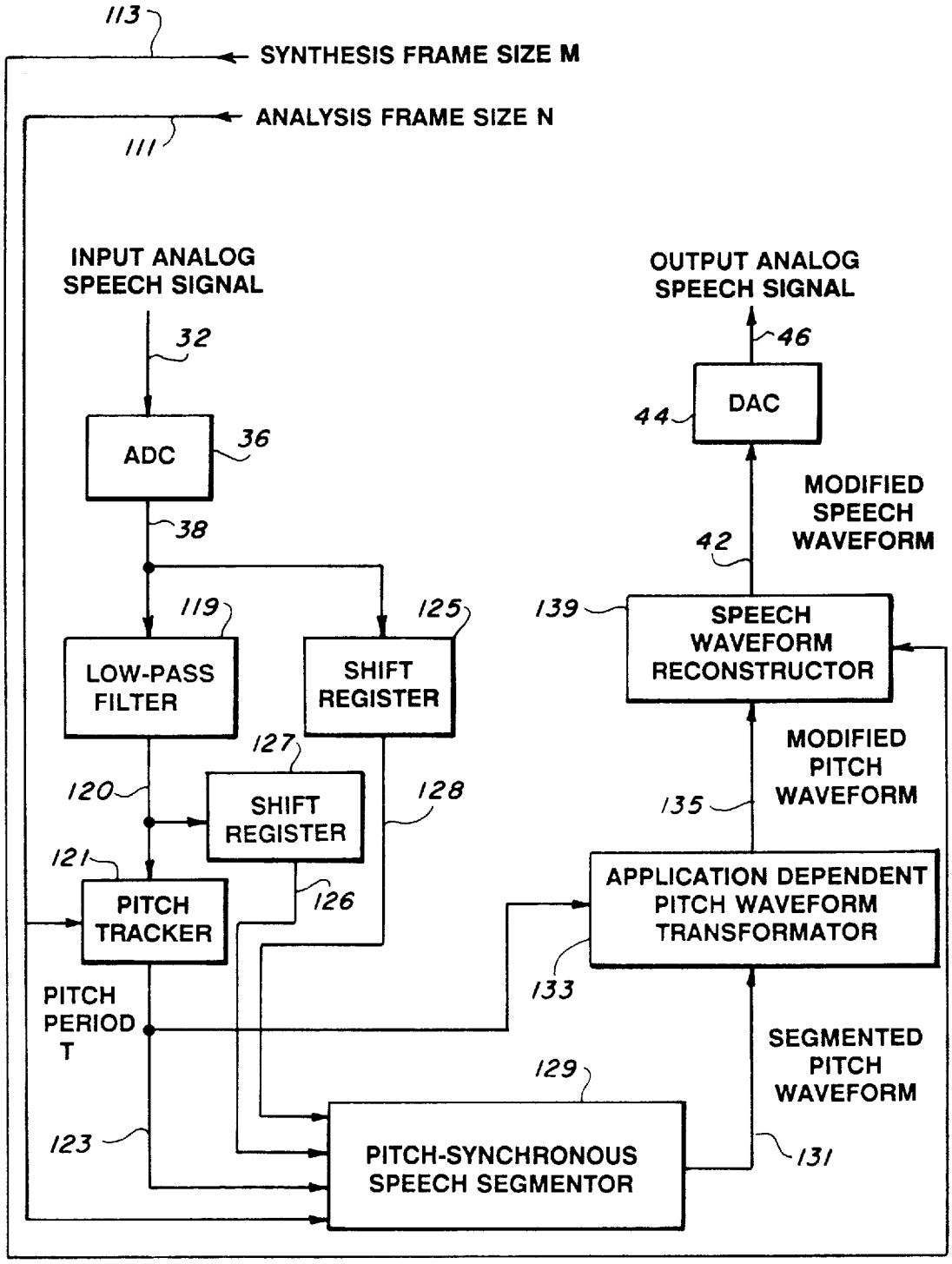
FIG. 9 shows the structural elements in the computer system 40 of FIG. 3 for performing the operations of segmenting and reconstructing a speech waveform.

FIG. 9 shows the structural elements in the computer system 40 of FIG. 3 for performing the operations of segmenting and reconstructing a speech waveform. As shown in FIG. 9, three inputs 111, 113 and 32 are provided: an analysis frame size N 111 (an integer from 60 to 240), a synthesis frame size M 113 (an integer from 60 to 240) and the input analog speech signal 32. The analysis frame size N 111 and the synthesis frame size M 113 are provided by the operator prior to start up of system 30 (FIG. 3). The analog signal 32 from an input device, such as a microphone, is converted by the ADC 36 into a series of digitized speech samples 38 supplied at an 8-kHz rate. Although not shown, the analog signal 32 is low pass filtered by the ADC 36 prior to the conversion to pass only signals below 4 kHz. The digitized speech samples 38 are conventionally filtered by a low-pass filter 119 to pass low pass filtered speech samples 120 at audio frequencies below about 1 kHz while the original signal is delayed in a shift register 125 (to be discussed) to produce delayed speech samples S(.) 128. The pitch of the low pass filtered speech samples 120 is pitch period tracked by a conventional pitch tracker 121 to produce the pitch period T 123 (FIG. 4). A conventional pitch tracker is described in Digital Processing Of Speech Signals, by Rabiner et al, Prentice-Hall, Inc., N.J. 1978, Chapter 4. The low pass filtered speech samples 120 are delayed in a shift register 127 (to be discussed). The delays of shift registers 125 and 127 are preselected to time align the low pass filtered speech samples S'(.) 126 and speech samples S(.) 128 with the pitch period T 123 for input to a pitch-synchronous speech segmentor 129. The pitch period T 123, the low pass filtered speech samples S'(.) 126, the speech samples S(.) 128 and the analysis frame size N 111 are used to perform segmentation in the segmentor 129 of the original signal as described with respect to FIG. 4. The segmented pitch waveform samples 131 are then transformed in an application dependent pitch waveform transformator 133, in one or more of the ways as previously discussed, to produce the modified pitch waveform 135. Speech is reconstructed in a speech waveform reconstructor 139 using the modified pitch waveform 135 and the synthesis frame size M 113 to produce the modified speech waveform 42. The modified speech waveform 42 is converted by DAC 44 into the output analog speech signal 46 which is supplied to an output device, such as a speaker (not shown).

The operations of FIG. 9, including the segmentation of FIG. 4, are described in more detail in the FORTRAN source code Appendix included herein.

Figure 11:
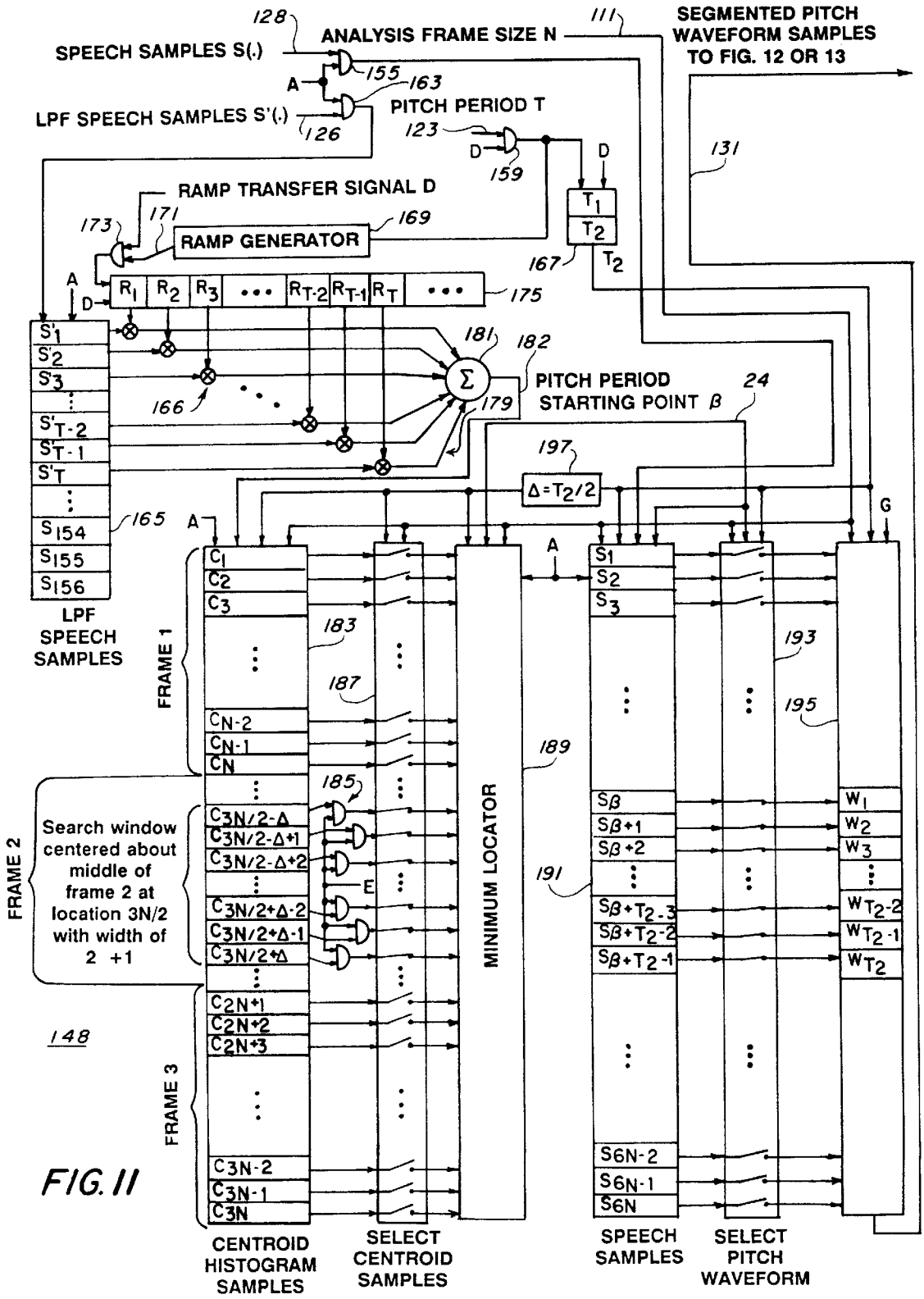
FIG. 11 depicts a discrete component embodiment of the invention.

In a hardware embodiment of the invention, the pitch synchronous segmentation of speech in the present invention can also be performed by an exemplary system 148 using discrete hardware components, as illustrated in FIG. 11. In the exemplary system 148, the minimum location and pitch period refinement 56 (FIG. 4) is not performed. Also, the analysis frame size N 111 is restricted to the range where $160 \leqq N \leqq 240$.

Figure 10A:
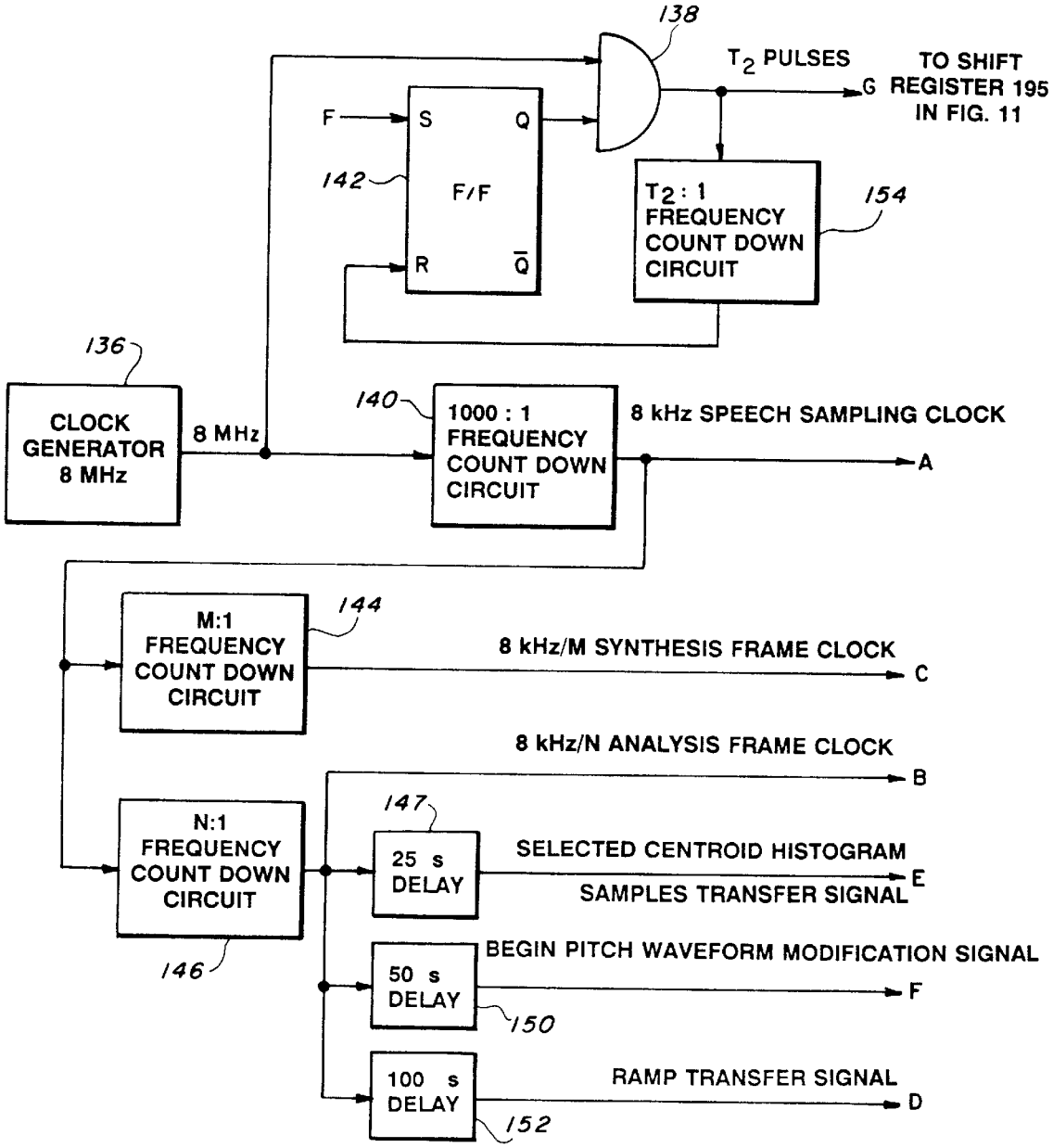
FIG. 10(*a*) illustrates timing circuits for generating various timing signals used in the system of FIG. 11.
Figure 10B:
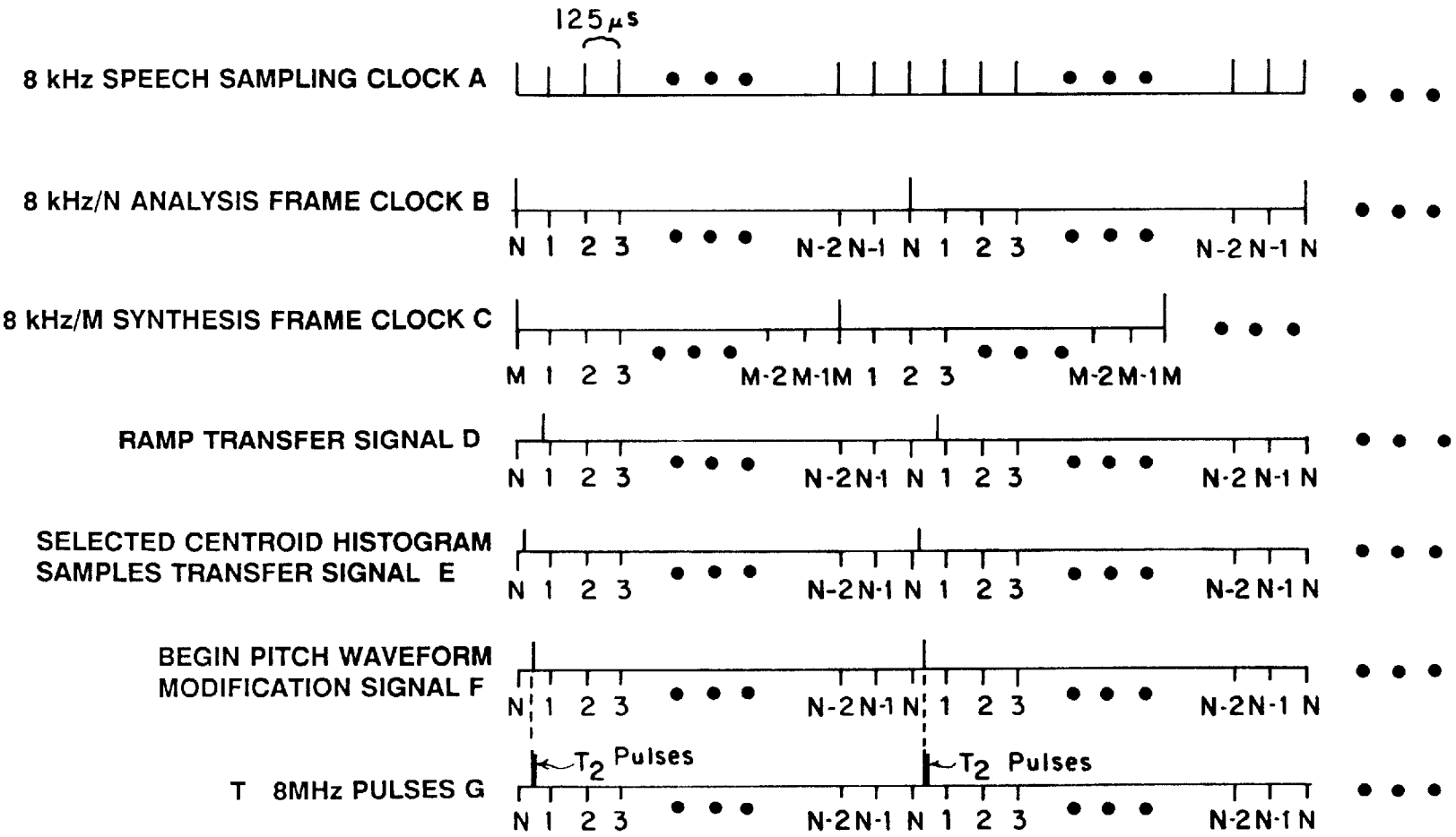

Before FIG. 11 is discussed, reference will now be made to FIGS. 10(*a*) and 10(*b*). FIG. 10(*a*) illustrates timing circuits for generating the various timing signals used in the system of FIG. 11, and FIG. 10(*b*) illustrates the control timing signals generated by the timing circuits of FIG. 10(*a*).

In FIG. 10(*a*), a clock generator 136 generates eight mega Hertz (8 MHz) clocks which are applied to an upper input of an AND gate 138 and to a 1000:1 frequency count down circuit 140. At this time the AND gate 138 is disabled by a 0 state signal from the Q output of a flip flop 142. The 8 MHz clocks are continuously counted down by the 1000:1 frequency count down circuit 140 to generate an 8 kHz speech sampling clock A (shown in FIG. 10(*b*)) each time that the count down circuit 140 counts 1000 8 MHz clocks and then is internally reset to zero (0) by the 1000 th 8 MHz clock. Note that the interpulse period of clock A is 125 microseconds ($\mu$s).

The 8 kHz speech sampling clock A is applied to M:1 and N:1 frequency count down circuits 144 and 146. It will be recalled that the synthesis frame size M 113 and the analysis frame size N 111 are internal parameters that can be altered by the operator. Thus, the values of M and N are selected by the operator.

The 8 kHz clock A is counted down by the M:1 frequency count down circuit 144 to generate an 8 kHz/M synthesis frame clock C (shown in FIG. 10 (*b*)) each time that the count down circuit 144 counts M 8 kHz A clocks and then is internally reset to 0 by the M th 8 kHz clock. In a similar manner, the 8 kHz clock A is counted down by the N:1 frequency count down circuit 146 to generate an 8 kHz/N analysis frame clock B (shown in FIG. 10(*b*)) each time that the count down circuit 146 counts N 8 kHz A clocks and then is internally reset to 0 by the N th 8 kHz clock.

The 8 kHz/N analysis frame clock B is also applied to a 25 $\mu$s delay circuit 147 to produce a selected centroid histogram samples transfer signal E (shown in FIG. 10 (*b*)) which occurs 25 $\mu$s after each B clock. In a similar manner, the 8 kHz/N B clock is applied to a 50 $\mu$s delay circuit 150 to produce a begin pitch waveform modification signal F (shown in FIG. 10 (*b*)) which occurs 50 $\mu$s after the B clock. The B clock is also applied to a 100 $\mu$s delay circuit 152 to produce a ramp transfer signal D (shown in FIG. 10 (*b*)) which occurs 100 $\mu$s after the B clock.

Each time that an F clock is generated by the 50 $\mu$s delay circuit 150, that F clock sets the flip flop 142 to cause the Q output of the flip flop 142 to change to a 1 state output. This 1 state output enables the AND gate 138 to pass 8 MHz clocks. These 8 MHz clocks from AND gate 138 will henceforth be called $T_2$ pulses G, which will be applied to a shift register 195 in FIG. 11 (to be discussed).

The $T_2$ pulses G from AND gate 138 are counted by a $T_2$:1 frequency count down circuit 154 to generate a $T_2$:1 signal each time that the count down circuit 154 counts $T_2$ pulses and then is internally reset to 0 by the $T_2$ th 8 MHz clock that occurs after the flip flop 142 is set. The $T_2$:1 clock also resets the flip flop 142 so that the Q output of the flip flop 142 changes to a 0 state to disable the AND gate 138. Thus, no more $T_2$ pulses G are supplied to the shift register 195 in FIG. 11 at this time.

As shown in FIG. 10(*b*), the $T_2$8 MHz pulses G start with the generation of the begin pitch waveform modification signal F and terminate after the frequency count down circuit 154 has counted $T_2$8 MHz pulses G after the generation of the F signal.

Referring back to FIG. 11, the parameter analysis frame size N 111 signal is applied to shift registers 183 and 191, switches 187 and 193, minimum locator 189, and parallel-to-serial shift register 195. Speech samples S(.) 128 are fed at the time of the A clocks through AND gate 155 to the shift register 191. Pitch period T 123 signal is fed at the time of the D clocks through AND gate 159 to a shift register 167 and a ramp generator 169. The low-pass filtered (LPF) speech samples S'(.) 126 are fed at the time of the A clock through AND gate 163 to a shift register 165.

A conventional pitch tracker 121 (FIG. 9) used for this embodiment is able to track pitch with a range of 51 Hz to 400 Hz. A low-pitch male voice of 51 Hz corresponds to a pitch period, T. of 156 speech samples. A high-pitch female voice of 400 Hz corresponds to a pitch period, T, of 20 speech samples. Thus, the segmentation process must be able to handle pitch waveforms having 20 to 156 speech samples. Shift register 165 retains 156 filtered speech samples S'(.) 126, and shift register 175 stores ramp samples $R_1$ to $R_T$.

A ramp generator 169 develops an appropriate ramp R(.) 171 to be fed at the time of the ramp transfer signal D through an AND gate 173 to the shift register 175. The number of ramp samples transferred is T, and the appropriate ramp $R_1$ to $R_T$ from the following list is transferred.

*R1* to *R20*: −10, −9, −8, ..., −1, 0, 1, ..., 7, 8, 9

*R1* to *R21*: −10, −9, −8, ..., −1, 0, 1, ..., 8, 9, 10

*R1* to *R22*: −11, −10, −9, ..., −1, 0, 1, ..., 8, 9, 10

... ...

... ...

... ...

*R1* to *R154*: −77, −76, −75, ..., −1, 0, 1, ..., 74, 75, 76

*R1* to *R155*: −77, −76, −75, ..., −1, 0, 1, ..., 75, 76, 77

*R1* to *R156*: −78, −77, −76, ..., −1, 0, 1, ..., 75, 76, 77

Corresponding ramp samples $R_1$ to $R_T$ from shift register 175 and corresponding low pass filter speech samples $S'_1$ to $S'_T$ from shift register 165 are respectively cross multiplied in associated multipliers 166 to develop and apply cross products 179 to a summation unit 181.

Cross-products 179 of filtered speech samples $S'_1$ to $S'_T$ with ramp $R_1$ to $R_T$ pass through the summation unit 181 to form centroid histogram samples C(.) 182 for feeding into buffer 183. Ramp $R_1$ to $R_T$ remains fixed over an analysis frame of N speech samples S(.) 128. An analysis frame of N filtered speech samples S'(.) 126 produces a frame of N sums of cross products designated $C_1$ to $C_N$ in register 183. $C_1$ to $C_N$ is also designated frame 1 in register 183. Because a pitch waveform can spread over three frames, selection of a pitch waveform progresses from the middle of the three frames of register 183, at location 3N/2. Location 3N/2 is positioned in the middle of frame 2 of register 183. Because the search is now centered in frame 2, a one frame delay is introduced in the segmentation process. Register 167 delays the pitch one frame to properly line up the pitch in time with frame 2 of register 183.

Analysis frame size N 111 samples is fixed prior to the start up of ADC 36 and DAC 44 (ADC and DAC are shown in FIGS. 3 and 9). Since N can range in the exemplary system 148 from 160 to 240 samples and the pitch period T 123 can range from 20 to 156 samples, three frames, 3N, of centroid samples are preserved in register 183.

The goal is to find a pitch waveform to associate with frame 2 of register 183. The beginning of the pitch cycle must be found such that a replication and concatenation process to be performed later will not create audible discontinuities. Each sum of cross products $C_1$ to $C_N$ from summation unit 181 that is fed into register 183 is an indication of the center of gravity of a pitch waveform. The midpoint of a new pitch waveform occurs when the center of gravity is at a relative minimum.

A search window for locating the segmented pitch waveform samples 131 (of FIGS. 4 and 11) is centered about the middle of frame 2. A search controller 197, such as a microprocessor, computes $\Delta=T_2/2$. The range of the search window is from centroid histogram sample $C_{3N/2-\Delta}$ to $C_{3N/2+\Delta}$ which encompasses $2\Delta-1$ samples, or a little greater than a pitch period of samples.

Once per analysis frame, centroid samples $C_{3N/2-\Delta}, \ldots, C_{3N/2+\Delta}$ are fed at the time of the E signal through AND gates 185 and through switch 187 to the minimum locator 189. Locator 189 is a conventional device, such as a microprocessor, used for finding the location of the minimum value of the centroid samples $C_{3N/2-\Delta}, \ldots, C_{3N/2+\Delta}$ within the locator 189. The pitch period starting point β 24 of the selected pitch waveform is in the range of $3N/2-\Delta$ to $3N/2+\Delta$. The starting point β 24 is passed to the switch 193. Switch 193 transfers $T_2$ speech samples from shift register 191 to shift register 195. Segmented pitch waveform samples 131 are available for the application dependent pitch waveform transformator 133. Shift register 191 has a size of 6N to have sufficient speech samples available.

Figure 12:
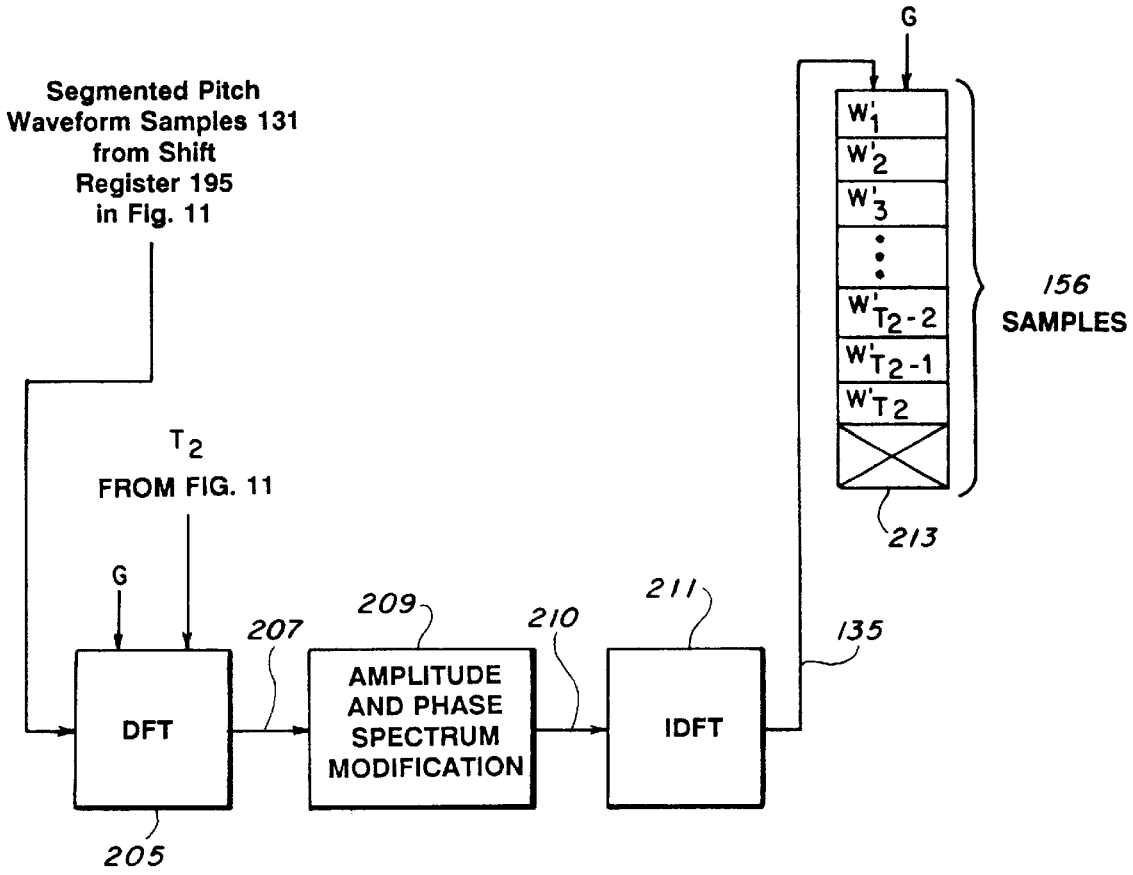
FIG. 12 depicts a first type of circuit for utilizing the segmented pitch waveform samples of FIG. 11 to modify the waveform spectrum.

FIG. 12 shows a first type of circuit for utilizing the segmented pitch waveform samples 131 output of FIG. 11 to modify the waveform spectrum. In this circuit of FIG. 12, resonant frequencies of the segmented pitch waveform 131 are altered. The application of timing signal G (FIGS. 10(*a*) and 10(*b*)) to the shift register 195 (FIG. 11) enables segmented pitch waveform samples 131 to be fed from the shift register 195 to a DFT unit 205. Amplitude and phase spectrum output 207 from DFT unit 205 are changed by an amplitude and phase spectrum modification unit 209 in a manner similar to that previously described in FIG. 8.

To explain this amplitude and phase spectrum modification being performed by circuit 209 of FIG. 12 reference will now be made back to the description of FIG. 8.

The resonant frequencies of speech can be modified by altering the pitch waveform spectrum. An example of altering the first resonant frequency is illustrated in FIG. 8. In step 1, a conventional DFT is applied to the segmented pitch waveform samples 131 to produce the amplitude spectrum 74. In step 2, the spectrum 74 is modified in some conventional manner to produce the modified amplitude spectrum 78. For example, the first resonant frequency in the spectrum 74 can be shifted to the left as shown by the spectrum 78. In step 3, a conventional Hilbert transformation is performed on spectrum 78 to produce the modified phase spectrum 82. In step 4, an IDFT is performed on amplitude spectrum 78 and phase spectrum 82 to produce the modified pitch waveform 135 with altered spectral characteristics. This waveform 135 can then be used to generate speech. This would tend to disguise speaker identity.

Now referring back to FIG. 12, a modified amplitude spectrum and phase spectrum signal 210 from the amplitude and phase spectrum modification unit 209 is inverted using an IDFT unit 211 and the resultant modified pitch waveform 135 is output to a 156 sample serial-to-parallel shift register 213.

FIG. 12 can be changed to pass the segmented pitch waveform samples 131 unaltered through the circuit of FIG. 12 by removing the amplitude and phase spectrum modification circuit 209 and applying the output of the DFT unit 205 directly to the input of the IDFT unit 211 or by applying the output from shift register 195 (FIG. 11) directly to the input of shift register 213.

Figure 13:
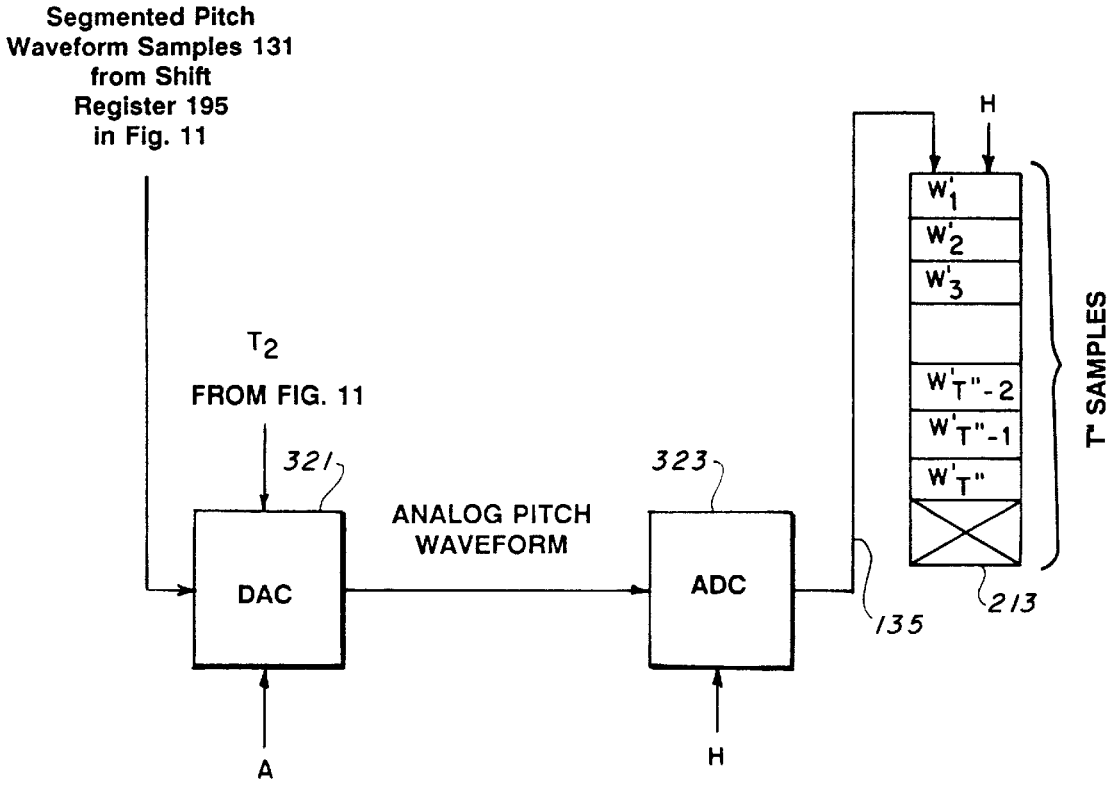
FIG. 13 depicts a second type of circuit for utilizing the segmented pitch waveform samples of FIG. 11 to modify the pitch.

Another alternate embodiment of the discrete component version of this invention is illustrated in FIG. 13. The segmented pitch waveform samples 131 stored in shift register 195 pass through a stretching or shrinking transformation. Pitch waveform samples 131 are applied to a DAC 321 with the 8 kHz clock A (clock A generation is shown in FIGS. 10(*a*) and 10(*b*)). The analog pitch waveform is resampled by an ADC 323 at a new sampling rate denoted by H (permissible values for H are 4 kHz≦H≦16 kHz) to create the modified pitch waveform 135 with T" samples stored in the shift register 213. Shrinking the pitch waveform raises the pitch, and expanding the pitch waveform lowers the pitch.

Figure 14:
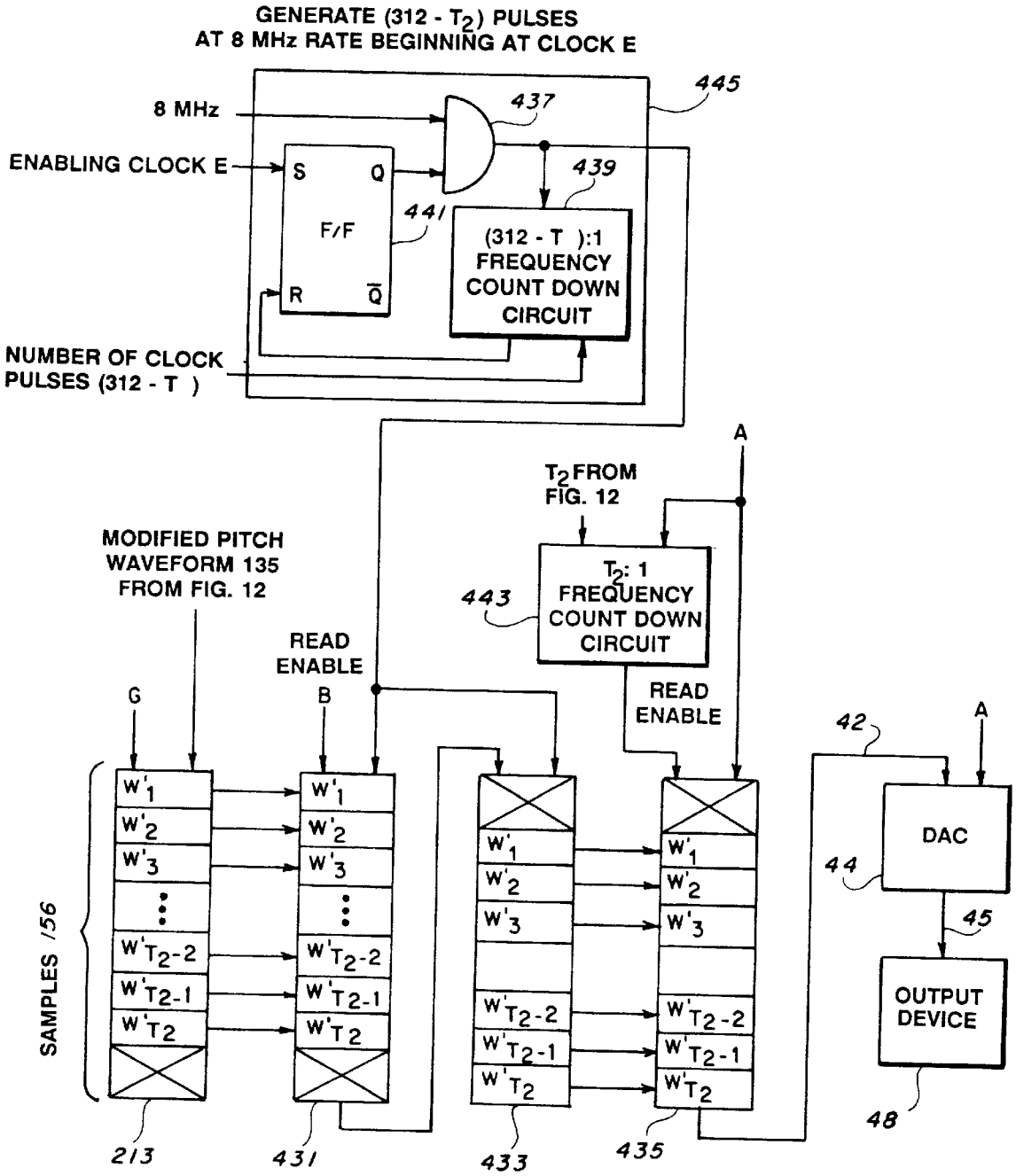
FIG. 14 depicts the components used for replicating and concatenating pitch waveforms to generate continuous analog speech.

A discrete component waveform reconstruction circuit is illustrated in FIG. 14. This circuit comprises the shift register 213, a 156-sample, serial-to-parallel shift register 433, and two 156-sample, parallel-to-serial shift registers 431 and 435. Since the pitch period T 123 has a range of 20 to 156 samples, each of the 156-sample registers 213, 431, 433, and 435 enable the storage of the maximum number of samples in a pitch waveform.

A control circuit 445 generates $312-T_2$ pulses at an 8 MHz rate beginning at the time that clock E is generated. The control circuit 445 includes a flip flop 441 which is enabled by clock E to allow 8 MHz pulses to pass through an AND gate 437. A frequency count down circuit 439 permits $312-T_2$8 MHz pulses to pass through the AND gate 437 before it counts to a count of $312-T_2$. When the frequency count down circuit 439 reaches a count of $312-T_2$, it resets the flip flop 441 and internally resets itself to a 0 count. When reset, the Q output of the flip flop 441 changes to a 0 state to disable the AND gate 437. At this time no further 8 MHz pulses can be output from the control circuit 445 until the flip flop 441 is reset by the next enabling E clock.

Modified pitch waveform 135 samples are updated once per analysis frame. For purposes of this description, the updating operation of FIG. 14 will be described in relation to the utilization circuit of FIG. 12. However, it should be understood that a similar description of FIG. 14 is also applicable to the utilization circuit of FIG. 13.

In operation, modified pitch waveform 135 samples from FIG. 12 are serially clocked into serial-to-parallel register 213 by the G clock (FIG. 10(*b*)), which G clock is comprised of $T_2$8 MHz clocks. At the time of the B clock, the stored samples in register 213 are shifted into and stored in parallel in the parallel-to-serial shift register 431. Since $T_2$ is often less than the 156-sample register-capacity of each of the registers 213 and 431, there is null data (i.e., data not related to the pitch waveform) comprising 156–$T_2$ samples positioned in time prior to the pitch waveform in the registers 213 and 431.

At the time of the next E clock, following the G clock during which the modified pitch waveform 135 samples were stored in the register 213, the flip flop 441 is set to enable AND gate 437 to pass 8 MHz clocks to registers 431 and 433. These 8 MHz clocks from AND gate 437 enable the samples stored in the register 431 to be serially clocked out of the register 431 into register 433. This transfer repositions the null data in time behind the speech data in register 433. More specifically, the first 156 clock pulses from the AND gate 437 in the circuit 445 transfer the entire contents of the register 431 to register 433, and the additional 156–$T_2$ clock pulses eliminate null data prior to the speech data in register 433.

The 8 MHz clocks from the AND gate 437 are also counted by a frequency count down circuit 439. When the circuit 439 reaches a count of (312–$T_2$) 8 MHz clocks, it generates a signal to reset the flip flop 441 to disable the AND gate 437 so that no further 8 MHz clock pulses are output from the control circuit 445 until the flip flop 441 is set by the next enabling clock E.

The 8 kHz clock A is fed to a frequency count down circuit 443 to transfer in parallel the contents of register 433 to register 435 and to internally reset the counter 443 to zero (0) when the counter 443 has counted $T_2$ A clocks. Finally, $T_2$ samples of register 435 are fed at an 8 kHz rate by clock A to form the waveform 42 which is then applied to the DAC 44 at the A clock rate. The entire pitch waveform comprised of $T_2$ samples must be transferred in its entirety. The resulting analog speech signal 46 is then applied to the output device 48.

Additional details of uses for the present invention can be found in Naval Research Laboratory report NRL/FR/5550-94-9743 entitled Speech Analysis and Synthesis Based on Pitch-Synchronous Segmentation of the Speech Waveform by the inventors Kang and Fransen, published Nov. 9, 1994 and available from Naval Research Laboratory, Washington, D.C. 20375-5320 and incorporated by reference herein.

Figure 15:
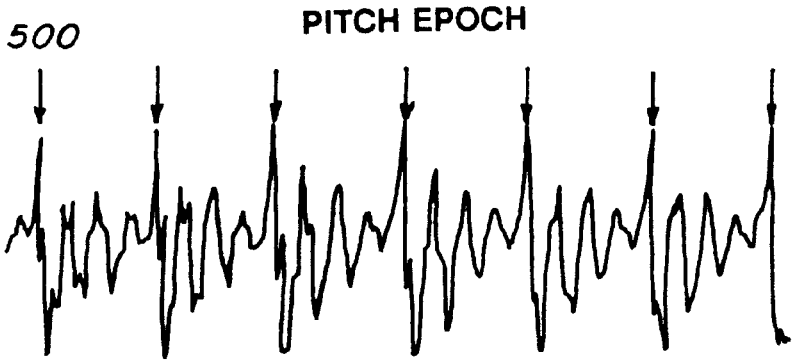
FIG. 15 illustrates an alternate approach to segmentation.

The present invention is described with respect to performing pitch synchronous segmentation using centroid analysis, however, the segmentation can be performed in other ways. A direct approach is a method that determines pitch epochs directly from the waveform. An example of such an approach is peak picking in which the peaks 500 of the pitch waveforms are used to find the segment speech waveform. For certain speech waveforms, such an approach is feasible because the speech waveform shows pitch epochs rather clearly as in FIG. 15. One should be warned, however, that many speech waveforms do not show pitch epochs clearly. This is particularly true with nonresonant high-pitch female voices. As a result, this approach is not preferred.

Contrary to the direct method which uses instantaneous values of speech samples, a correlation method makes pitch epoch determination based on the ensemble averaging of a certain function derived from the speech waveform. The centroid method presented previously is a correlation process. The concept of the centroid originated in mechanical engineering to determine the center of gravity of a flat object. The concept of the center of gravity has been used in the field of signal analysis in recent years (See Papoulis A, Signal Analysis, McGraw-Hill Book Company, New York, N.Y. 10017). For the speech waveform, the quantity x is a time variable, f(x) is the speech waveform, x1 is the pitch epoch, and x2–x1 is the current pitch period which is known beforehand. As elaborated in NRL Report 9743 (previously referenced), the above expression produces virtually identical pitch epoch locations as the following simplified expression:

$$\eta = \int_{x1}^{x2} xf(x)dx \quad \text{for } x1 \le x \le x2. \tag{6}$$

Figure 16:
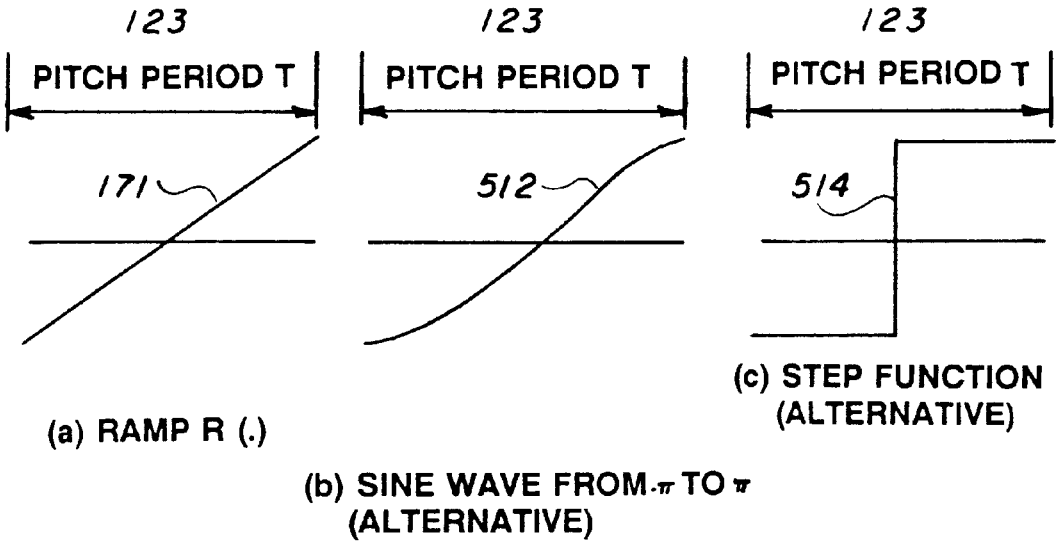
FIG. 16 depicts different functions used in correlation.

Thus, the centroid function is a cross correlation function between a ramp function and f(x). Ramp R(.) 171, as illustrated in FIG. 16, appearing in the above equation is odd-symmetric with respect to its midpoint. Other odd symmetric functions, such as a sine function 512 and a step function 514 of FIG. 16, can be used as a substitute for the ramp function. However, these alternative functions do not work as well as the ramp function and are thus not preferred.

The advantages of the present invention include the following. Speech utterance rate can be changed without altering the pitch or resonant frequencies. Pitch can be changed without altering the utterance rate. Resonant frequencies can be changed by spectrally shaping the pitch waveform without altering the utterance rate or pitch. The modified speech is similar to the original speech (not synthetic speech). Thus, the transformed speech intelligibility and quality are excellent. This invention has the feature of segmenting the speech waveform in terms of the pitch waveform. In the invention, the pitch waveform is a minimum inseparable entity of the speech waveform. Modification of the pitch waveform leads to speech characteristic alteration.

The many features and advantages of the invention are apparent from the detailed specification and, thus, it is intended by the appended claims to cover all such features and advantages of the invention which fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

APPENDIX

Navy Case No. 77,023
(FORTRAN Source Code)

```
c       NOTE    This program segments the speech waveform pitch
c               synchronously. The segmented pitch waveform is
c               replicated and concatenated to generate
c               continuous speech. The analysis frame size N
c               and synthesis frame size M are user specified.
c               Speech can be sped up by making N>M, or speech
c               may be slowed down by making N<M.
c
        integer T,Tprime,ubnd
        integer*2 is(240),idc(240),ilpf(240),ix(1)
        integer*2 i5dc(1200),i5lpf(1200)
        dimension amp(80),amp1(80),amp2(80),ampi(80)
        dimension phase(80),phase1(80),phase2(80),phasei(80)
        dimension pps(160),pw(160),xx(160)
        character*75 fname
c
c       - - - - - voice i/o setup - - - - -
c
        write(6,1000)
```

APPENDIX-continued

Navy Case No. 77,023
(FORTRAN Source Code)

```
1000    format('enter input speech file'/)
        read(5,1001) fname
1001    format(a)
c
c       *** initialize input device (not shown)
c
        write(6,1002)
1002    format('enter output speech file'/)
        read(5,1001) fname
c
c       *** initialize output device (not shown)
c
c
c       - - - - - initialization - - - - -
c
c       *** analysis frame size N:   60<=N<=240
c
        N=100
c
c       *** synthesis frame size M: 60<=M<=240
c
        M=100
c
c       *** constants
c
        lpfoffset=9
        twopi=2.*3.14159
c
c       - - - - - input speech samples - - - - - - - -
c
c       *** transfer N speech samples into array is(.)
c       *** in indicates how many samples actually transferred
c       *** subroutine spchin is not shown
c
100     call spchin(N,is,in)
        if(in.eq.0) go to 999
        ifrmct=ifrmct+1
c
c       = = = = = = = preprocessing = = = = = = = =
c
c       - - - - - remove dc from speech - - - - -
c
        do 110 i=1,N
        x=is (i)
        call dcremove (x,y)
110     idc(i)=y
c
c       - - - - - store 5 dc-removed frames - - - - -
c
        do 120 i=1,N
        i5dc(i)=i5dc(i+N)
        i5dc(i+N)=i5dc(i+2*N)
        i5dc(i+2*N)=i5dc(i+3*N)
        i5dc(i+3*N)=i5dc(i+4*N)
120     i5dc (i+4*N)=idc(i)
c
c       - - - - - low-pass filter - - - - -
c
        do 130 i=1,N
        x=idc(i)
        call lpf(x,y)
130     ilpf(i)=y
c
c       - - - - -store 5 low-passed frames - - - - -
c
        do 140 i=1,N
        i5lpf(i)=i51pf(i+N)
        i5lpf(i+N)=i5lpf(i+2*N)
        i5lpf(i+2*N)=i5lpf(i+3*N)
        i5lpf(i+3*N)=i5lpf(i+4*N)
140     i5lpf(i+4*N)=ilpf(i)
c
c       = = = = analysis = = = =
c
c       - - - - - pitch tracker - - - - -
c
```

APPENDIX-continued

Navy Case No. 77,023
(FORTRAN Source Code)

```
c       NOTE    Use any reliable pitch tracker with an internal
c               two frame delay (pitch tracker not shown)
c
        call pitch(N,i5lpf,T)
        if(T.gt.128) T=128
c
c       - - - - - upper and lower bounds of search window - - - - -
c
        icenter=2.5*N
        if (icenter.lt.T) icenter=T
        lbnd=icenter-.5*(T+1)
        ubnd=icenter+.5*(T+1)
c
c       - - - - - find pitch epoch and refine - - - - -
c
c       call centroid(lbnd,ubnd,T,i5lpf,small,loc)
        call adjust(T.loc,i5lpf,small,sadj,locadj,Tprime)
c
c       - - - - - compensate for lpf delay - - - - -
c
        locadj=locadj-lpfoffset
c
c       - - - - - extract one pitch-waveform and compute rms - - - - -
c
        index=locadj-Tprime/2
        if(index.ge.1) go to 150
        index=1
150     k=0
        sum=0.
        do 160 i=index,index+Tprime-1
        k=k+1
        pps(k)=i5dc(i)
160     sum=sum+pps(k)**2
        rms=sqrt(sum/Tprime)
c
c       NOTE    Introduce pitch modification here (expand or
c               compress pps(.) and change Tprime accordingly)
c
c       - - - - - Fourier transform the extracted pitch waveform - - - - -
c
c       NOTE    The pitch waveform is interpolated in the
c               frequency domain during the intra-pitch period
c
        call dft(Tprime,pps,amp,phase,nn)
c
c       NOTE    Introduce spectrum modification here
c
        do 170 i=nn+1,80
        amp(i)=0.
170     phase(i)=0.
c
c       - - - - - store two frames of data - - - - - -
c
c       *** amplitude spectrum of pitch waveform
c
        do 180 i=1,80
        amp2(i)=amp1(i)
180     amp1(i)=amp(i)
c
c       *** phase spectrum of pitch waveform
c
        do 181 i=1,80
        phase2(i)=phase1(i)
181     phase1(i)=phase(i)
c
c       *** pitch period
c
        ipt2=ipt1
        ipt1=Tprime
c
c       *** pitch waveform rms
c
        irms2=irms1
        irms1=rms
c
```

APPENDIX-continued

Navy Case No. 77,023
(FORTRAN Source Code)

```
c       - - - - - interpolation rate - - - - -
c
c       NOTE    Use a faster interpolation if rms changes
c               significantly across frame boundary
c
        ratio=iabs(irms1-irms2)
        if(ratio.le.3.) ur=1.
        if(ratio.gt.3.and.ratio.le.6) ur=1.2
        if(ratio.gt.6) ur=1.4
c
c       = = = = = = synthesizer = = = = = = =
c
        do 300 l=1,M
c
        if(im-ipti)240,200,200
200     im=0
c       - - - - - pitch epoch - - - - -
c
c       NOTE    At each pitch epoch, amplitude normalize
c               the pitch waveform of the previous pitch
c               period and dump out sample by sample.
c
c       *** amplitude normalization factor
c
        sum=0.
        do 210 i=1,ipti
210     sum=sum+xx(i)**2
        gain=rmsi/sqrt(sum/ipti)
c
c       *** amplitude normalize past pitch waveform
c
        do 220 i=1,ipti
        u3=u2
        u2=u1
        u1=gain*xx(i)
c
c       *** perform 3-point interpolation only at pitch epoch
c
        u0=u2
        if(i.eq.2) u0=.25*u3+.5*u2+.25*u1
c
c       *** dump out sample by sample
c
        if(u0.gt.32767.) u0=32767.
        if(u0.1t.-32767.) u0=-32767.
        ix(1)=u0
c
c       *** output one speech sample from array ix(.)
c       *** subroutine spchout is not shown
c
220     call spchout(1,ix)
c
c       *** interpolation factor
c
        factor=ur*1/float(M)
        if(factor.gt.1.) factor=1.
c
c       *** rms interpolation
c       rmsi=irms2+factor*(irms1-irms2)
c
c       *** pitch interpolation
c
        ipti=ipt2+factor*(ipt1-ipt2)
c
c       *** amplitude spectrum interpolation
c
        do 230 i=1,80
230     ampi(i)=amp2(i)+factor*(amp1(i)-amp2(i))
c
c       *** phase spectrum selection
c
        if(factor.gt..5) go to 235
        do 232 i=1,80
232     phasei(i)=phase2(i)
        go to 238
c
```

APPENDIX-continued

Navy Case No. 77,023
(FORTRAN Source Code)

```
235     do 236 i=1,80
236     phasei(i)=phase1(i)
c
c       - - - - - inverse discrete Fourier transform - - - - -
c
238     call idft(ipti,ampi,phasei,pw)
c
c       - - - - - if not pitch epoch - - - - -
c
240     im=im+1
        xx(im)=pw(im)
300     continue
        go to 100
c
c       - - - - - - - - - - - - - - - - - - - - - - - - - - - - - - - -
c
999     end
c
c       = = = = = subroutines = = = = =
c
c       - - - - - dc remove subroutine - - - - -
c
        subroutine dcremove(a,b)
c
        b=(a-a1).+.9375*b1
        a1=a
        b1=b
        if(b.gt.32767.) b=32767.
        if(b.lt.-32767.) b=-32767.
        return
        end
c
c       - - - - - low-pass filter subroutine (-3 db at 1025 hz) - - - - -
c
        subroutine lpf (r1,r2)
c
        y19=y18
        y18=y17
        y17=y16
        y16=y15
        y15=y14
        y14=y13
        y13=y12
        y12=y11
        y11=y10
        y10=y9
        y9=y8
        y8=y7
        y7=y6
        y6=y5
        y5=y4
        y4=y3
        y3=y2
        y2=y1
        y1=r1
        r2=.010*(y1+y19)+.013*(y2+y18)+.001*(y3+y17)-
        .024*(y4+y16)
&       -.045*(y5+y15)-.030*(y6+y14)+.039*(y7+y13)+.147*(y8+y12)
&       +.247*(y9+y11)+.285*y10
        if (r2.gt.32767.) r2=32767.
        if(r2.lt.-32767.) r2=-32767.
        return
        end
c
c       - - - - - pitch epoch finding subroutine - - - - -
c
        subroutine centroid(i1,i2,ipp,i5lpf,small,loc)
        integer*2 i5lpf(1200)
c
        small=1000000.
        do 110 i<i1,i2
        sum=0.
        do 100 j=-ipp/2,-ipp/2+ipp-1
```

APPENDIX-continued

Navy Case No. 77,023
(FORTRAN Source Code)

```
100     sum=sum+j*i5lpf(i+j)
        if(sum.gt.small) go to 100
        small=sum
        loc=i
110     continue
        return
        end
c
c       - - - - - pitch epoch refinement subroutine - - - - -
c
        subroutine adjust (ipp,loc,i5lpf,small,sadj,locadj,ippadj)
        integer*2 i5lpf(1200)
c
        locadj=0
        Tprime=0
        sadj=1000000.
        irng=ipp/16
        do 110 i=loc-irng,loc+irng
        do 110 k=-irng,irng
        sum=0.
        do 100 j=-(ipp+k)/2,-(ipp+k)/2+(ipp+k)-1
100     sum=sum+j*i5lpf(i+j)
        if(sum.gt.sadj) go to 100
        sadj=sum
        locadj=i
        ippadj=ipp+k
110     continue
        return
        end
c
c       - - - - - discrete Fourier transform - - - - -
c
        subroutine dft(ns,e1,amp,phase,nn)
        dimension e1(160),amp(80),phase(80)
c
        if(mod(ns,2).eq.0) nn=ns/2+1
        if(mod(ns,2).eq.1) nn=(ns+1)/2
        p=2.*3.1415926/ns
        tpi=2.*3.1415926
        tpit=tpi*(1./8000.)
        fs=8000./ns
c
100     do 110 j=1,nn
        rsum=0.
        xsum=0.
        const=tpit*fs*(j-1)
        do 120 i=1,ns
        arg=const*(i-1)
        rsum=rsum+e1(i) *COS(arg)
        xsum=xsum+e1(i) *sin(arg)
120     continue
        r=rsum/ns
        x=xsum/ns
        amp(j)=sqrt(r**2+x**2)
        phase (j)=atan2(x,r)
110     continue
        return
        end
c
c       - - - - - inverse discrete Fourier transform - - - - -
c
        subroutine idft(ns,amp,phase,e2)
        dimension e2(160),amp(80),phase(80)
c
        if(mod(ns,2).eq.0) nn=ns/2+1
        if(mod(ns,2).eq.1) nn=(ns+1)/2
        p=2.*3.1415926/ns
        tpi=2.*3.1415926
        tpit=tpi*(1./8000.)
        fs=8000./ns
c
        amp(1)=.5*amp(1)
        if(mod(ns,2).eq.0) amp(nn)=.5*amp(nn)
        do 210 i=1,ns
        tsum=0.
        const=tpit*fs*(i-1)
```

APPENDIX-continued

Navy Case No. 77,023
(FORTRAN Source Code)

```
        do 220 j=1,nn
        arg=const*(j-1)
        tsum=tsum+amp(j) *cos(arg-phase(j))
220     continue
        e2(i)=2*tsum
210     continue
300     return
        end
```

What is claimed and desired to be secured: By Letters Patent of the United States is:

1. A method of speech processing, comprising the steps of:

determining a pitch period of a speech waveform;

defining a pitch waveform corresponding to the pitch period, said defining step including the step of locating a center of the pitch period, said step of locating the center of the pitch period including the step of determining a centroid of the pitch period, said step of determining the centroid including the steps of low pass filtering the speech waveform, and finding a local minimum in a centroid histogram waveform derived from the low pass filtered speech waveform; and segmenting the speech waveform responsive to the pitch waveform and the pitch period.

2. A method as recited in claim 1, wherein the segmenting step produces a segmented pitch waveform of the speech waveform and further comprising performing speech processing using the segmented pitch waveform including one of altering an utterance rate of the segmented pitch waveform, altering the pitch period of the segmented pitch waveform, altering the shape of the segmented pitch waveform and modifying the resonant frequencies of the segmented pitch waveform.

3. A method of speech processing, comprising the steps of:

low pass filtering an analog speech signal;

converting the analog speech signal into a digital speech signal;

low pass filtering the digital speech signal;

determining a pitch period of the low pass filtered digital speech signal;

segmenting the digital speech signal into pitch period segments, comprising:

generating a ramp function signal having the pitch period;

correlating the ramp function signal with the low pass filtered digital speech signal to produce a centroid histogram waveform signal;

determining a local minimum in the centroid histogram waveform signal;

refining the pitch period and the local minimum to obtain a more accurate segmented pitch waveform; and storing a pitch waveform segment responsive to the pitch period and the local minimum;

performing pitch waveform segment transformation;

constructing a modified speech signal from the transformed pitch waveform segment by replicating and concatenating the transformed pitch waveform segments; and converting the modified speech signal into a modified analog speech signal.

4. A speech processor comprising:

means for defining a pitch waveform corresponding to a pitch period, said defining means including means for locating a center of said pitch period, said locating means including means for determining a centroid of said pitch period, said determining means including means for low pass filtering the speech waveform and means for finding a local minimum in a centroid histogram waveform derived from the low pass filtered speech waveform; and means for segmenting the speech waveform responsive to the pitch waveform and the pitch period.

5. A speech processor comprising:

means for low pass filtering an analog speech signal;

means for converting the analog speech signal into a digital speech signal;

means for low pass filtering the digital speech signal;

means for determining a pitch period of the low pass filtered digital speech signal;

means for segmenting the digital speech signal into pitch period segments, said segmenting means comprising;

means for generating a ramp function signal having the pitch period;

means for correlating the ramp function signal with the low pass filtered digital speech signal to produce a centroid histogram waveform signal;

means for determining a local minimum in the centroid histogram waveform signal;

means for refining the pitch period and the local minimum to obtain a more accurate segmented pitch waveform; and means for storing a pitch waveform segment in response to the pitch period and the local minimum;

means for performing pitch waveform segment transformation;

means for constructing a modified speech signal from the transformed pitch waveform segment by replicating and concatenating the transformed pitch waveform segments; and means for converting the modified speech signal into a modified analog speech signal.

* * * * *